US006684415B1

(12) United States Patent
Kozono

(10) Patent No.: US 6,684,415 B1
(45) Date of Patent: Feb. 3, 2004

(54) VENTILATION APPARATUS

(76) Inventor: Yoshiya Kozono, 1913, Shitai, Kokubu-shi, Kagoshima 899-4463 (JP)

( * ) Notice: Subject to any disclaimer, the term of this patent is extended or adjusted under 35 U.S.C. 154(b) by 0 days.

(21) Appl. No.: 10/030,733

(22) PCT Filed: Jul. 13, 2000

(86) PCT No.: PCT/JP00/04697

§ 371 (c)(1),
(2), (4) Date: Feb. 27, 2002

(87) PCT Pub. No.: WO01/06065

PCT Pub. Date: Jan. 25, 2001

(30) Foreign Application Priority Data

Jul. 14, 1999 (JP) ..... 11/199735

(51) Int. Cl.[7] ..... E03D 9/04
(52) U.S. Cl. ..... 4/211; 137/512
(58) Field of Search ..... 4/211, 219; 137/218, 137/512

(56) References Cited

U.S. PATENT DOCUMENTS

| | | | | | |
|---|---|---|---|---|---|
| 428,278 | A | * | 5/1890 | Kelly | 4/211 X |
| 992,882 | A | * | 5/1911 | Kletzsch | 4/211 |
| 1,240,254 | A | * | 9/1917 | Prescott et al. | 137/512 X |
| 2,756,763 | A | * | 7/1956 | Morgenstern | 137/512 X |
| 4,282,897 | A | * | 8/1981 | de Mey, II | 137/512 X |

FOREIGN PATENT DOCUMENTS

| | | | |
|---|---|---|---|
| EP | 0750074 | A1 | 12/1996 |
| EP | 0754895 | A2 | 1/1997 |
| EP | 0867569 | A2 | 9/1998 |
| JP | 3031275 | U | 9/1996 |
| JP | 8226153 | A | 9/1996 |

* cited by examiner

*Primary Examiner*—Robert M. Fetsuga
(74) *Attorney, Agent, or Firm*—Fildes & Outland, P.C.

(57) ABSTRACT

There is provided a drain pipe ventilating apparatus that prevents water seal from being broken by supplying air to a drain pipe without using a ventilation pipe having a vent hole installed at a high position.

The ventilating apparatus to supply the air to the drain pipe includes a first ventilation pipe (1) and a second ventilation pipe (2) each having a spherical body (3, 3A) which freely moves up and down therein is characterized in that:

the first ventilation pipe (1) has an opening at a lower end thereof to connect to the conduit at a predetermined point, the second ventilation pipe (2) has an opening at a lower end thereof to serve as an air intake port, an upper end of the first ventilation pipe (1) and an upper end of the second ventilation pipe (2) are communicated with each other so that an air path is formed from the lower end of the second ventilation pipe to the lower end of the first ventilation pipe, and the air path is opened and closed by at least one of the spherical bodies moving up and down in the ventilation pipe in accordance to a force acting on the spherical body.

35 Claims, 6 Drawing Sheets

*Fig. 8* *(PRIOR ART)*
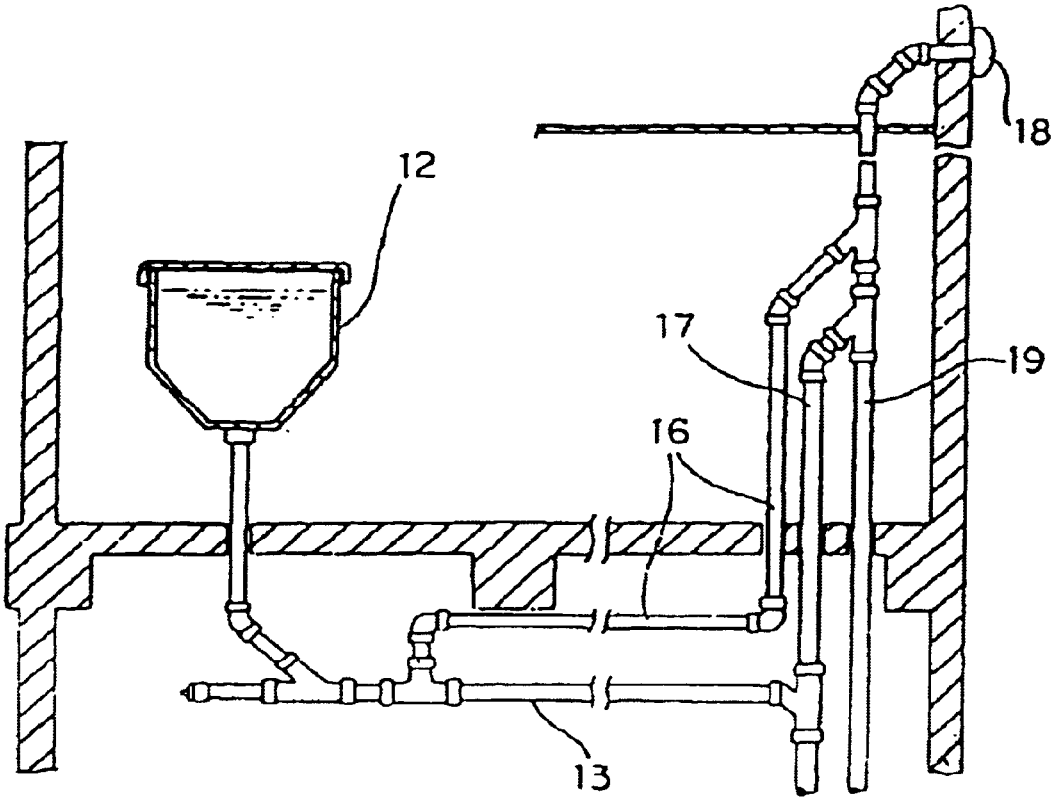
*Fig. 9* *(PRIOR ART)*
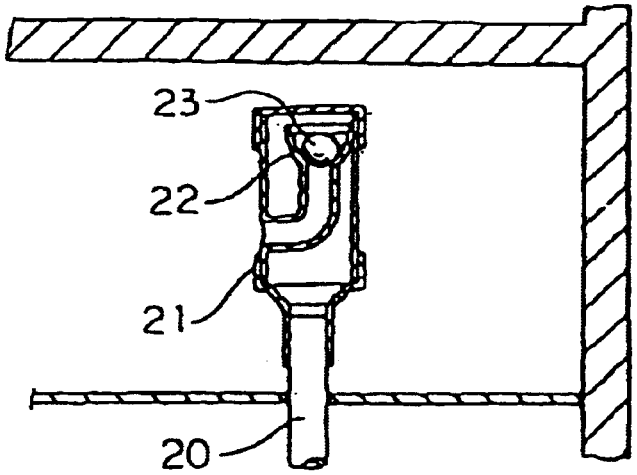

VENTILATION APPARATUS

FIELD OF THE INVENTION

The present invention relates to a ventilation apparatus that supplies a gas to a transportation pipe carrying a liquid, and more specifically to a drain pipe ventilating apparatus that is capable of preventing the breakage of water seal by ventilating a drainage path of a drain pipe, without installing a ventilation pipe such as individual ventilation pipe or a circuit ventilation pipe that has a vent hole at a high position thereof.

DESCRIPTION OF THE BACKGROUND ART

When a liquid (for example, water or waste water) held in a container is allowed to flow down (be drained, for example) in a flash by making use of the difference in height (namely, water head difference or gravity), a pressure in a transportation pipe (for example, a drain pipe) before the liquid passes is different from that pressure after the liquid has passed in case the cross section of the pipe is filled with the liquid in part of the inner space of the transportation pipe. That is, it is well known that, when a plug of liquid passes through the transportation pipe while filling the cross section thereof, a given point in the transportation pipe receives a positive pressure as the plug of liquid approaches that point and a negative pressure as the plug of water moves away from that point. At the given point in the transportation pipe, the positive pressure is generated since the flowing plug of liquid compresses the gas lying ahead before the liquid passes the point, while the negative pressure is created by the empty space created behind the plug of liquid to suck a gas into the empty space after it has passed the point.

At one point in the transportation pipe before a mass of liquid passes, the gas lying ahead of the coming mass of liquid is compressed by such mass and the pressure at that point increases (thus, the positive pressure is generated), and after the liquid has passed, the excessively negative pressure (or reduced pressure) is created (therefore, the pressure in the transportation pipe is lower than in the outside thereof) since the space evacuated by the mass of liquid is not promptly filled with a gas.

Liquid transportation systems of which transportation pipe is subjected to a positive pressure and a negative pressure as described above include a drainage system. Therefore, problems encountered in the drainage system and a ventilation apparatus of the present invention employed in the drainage system as means for solving the problem will be described below as examples. It should be noted, however, that the ventilation apparatus of the present invention is not limited to the application to the drainage systems but can be applied to a system that carries any liquid as long as the system involves a transportation pipe that carries a liquid. The liquid may include solids and/or gas as long as the liquid and the other matters carried by the liquid can be regarded as a fluid as a whole. In the description of the ventilation apparatus of the present invention that follows, liquid will be referred to as "water" or "water or waste water" as a representative thereof. However, the ventilation apparatus of the present invention can be applied to a system that drains a liquid other than water or waste water.

In a drainage system that drains from an apparatus such as a liquid container, in general, a drain pipe serving as a transportation pipe has a water seal portion (or trap, installed therein. When an excessive negative pressure is developed in the drain pipe of the drainage system, a kind of a siphoning phenomenon occurs in the pipe. This decreases a quantity of the sealing water, which leads to the breakage of the water seal (or loss of the sealing water), thus giving rise to such problems as odor escaping from the drain pipe to the outside, or suction sound being heard when draining.

A typical measure to counter this problem will be described below with reference to FIG. 8. FIG. 8 schematically shows a drainage system that drains water or waste water held in a container (12) through a drain pipe (13) by means of difference of elevation. Connected to the drain pipe (13) are ventilation pipes (16, 17) at proper positions in the drainage path. When a negative pressure is created in the drain pipe (13), air is supplied to the drain pipe (13) through the ventilation pipes (16, 17) by means of the atmospheric pressure. Thus the inner pressure of the drain pipe (13) is prevented from decreasing excessively.

The ventilation pipes (16, 17) communicate with a ventilation pipe (19) that runs vertically along the inner wall of the building. A vent hole of the ventilation pipe (19) is installed on the external wall of the building at a high position, and is called a wire cage. The vent hole (18) is usually installed on the external wall of the building at such high position in order to prevent water or waste water from overflowing from the ventilation pipe when the drain pipe (13) is clogged, and also to discharge odor generated from the waste water in the drain pipe to the outside of the building up in the air.

As other method, Japanese Patent Publication No. 2729353 (Japanese Unexamined Patent Publication No. 8-4071) discloses a ventilation valve for a drain pipe fitted with a vent hole installed indoors at a high position. Configuration of this device will be described below with reference to FIG. 9. FIG. 9 shows a ventilation pipe (20) provided with a ventilation valve (21) that introduces air into the ventilation pipe (20) by moving a ball (23) upward. The ventilation valve (21) prevents odor from escaping to the outside with the ball (23) seated on a funnel-shaped valve seat (22). In this ventilation valve, the ball cannot properly seat when there is a foreign matter between the ball (23) and the valve seat (22). Since water may leak to the outside in such a case, it is necessary to installed the vent hole of the ventilation pipe at the high position.

DISCLOSURE OF THE INVENTION

The vent hole is installed at the high position in either of the drainage systems described with references to FIG. 8 and FIG. 9. Therefore, when installing the drainage system, it is necessary to make holes in the floor, ceiling and wall of the building to run the ventilation pipe therethrough in order to install the vent hole at the high position. This may cause the ventilation pipe to be exposed from the floor surface or the wall surface, which makes an unfavorable appearance, or the vent hole installed on the external wall of the building at the high position may affect the appearance of the building exterior.

In the case of a larger building, since the drain pipe extends over a longer horizontal distance, the ventilation pipe must be connected to the drain pipe at a larger number of points, resulting in the more complicated configuration of the individual ventilation passages and the circuit ventilation passages. This makes it difficult to reduce the period and cost of building construction, since a large quantity of piping materials, working hours and construction expense are required to install the drainage system.

The present invention has been made to solve the problems of the drainage system of the prior art as described above. A major object of the present invention is to provide a drain pipe ventilating apparatus that prevents water seal from being broken by supplying air (or gas) to a drain pipe as required, and has such features as 1) the apparatus is installed onto the drain pipe easily in a limited space; 2) leakage of odor and waste water from the drain pipe is not allowed; and 3) the drain pipe can be ventilated without using a ventilation pipe having a vent hole installed at a high position, namely to provide a compact drain pipe ventilating apparatus. Specifically, a major object of the present invention is to provide a drain pipe ventilating apparatus that can be installed at a position lower than sanitary drainage fittings for drainage (such as wash basin and kitchen sinks) and can be installed indoors instead of the individual ventilation pipe or circuit ventilation pipe.

In order to achieve the object as described above, the present invention provides:

(1) A drain pipe ventilating apparatus comprising a ventilation pipe connected to a predetermined point of a drain pipe and a ventilation pipe communicating to the outside atmosphere which are installed in parallel to each other preferably vertically each ventilation pipe having a spherical body placed movably up and down therein, and a communicating path connecting the two ventilation pipes at the top end thereof so that an air path extending through the two ventilation pipes is formed, wherein the air path is opened or closed by at least one of the spherical bodies moving up or down in accordance to a force acting on said at least one of the spherical bodies when waste water passes the predetermined point of the drain pipe;

(2) The drain pipe ventilating apparatus according to the above apparatus (1), wherein a valve seat which the spherical body moving up in the ventilation pipe is seated on (or abutted to), particularly a valve seat made of an elastic material (such as a rubber packing) and with which the spherical body tightly contacts thereby to form a seal is installed in an upper portion of an air passage in the ventilation pipe which is connected to the predetermined point of the drain pipe, a stopper to stop the downward movement of the spherical body is installed in a lower portion of said air passage, a valve seat which the spherical body moving down in the ventilation pipe is seated on (or abutted to), particularly a vale seat made of an elastic material (such as a rubber packing) and with which the spherical body tightly contacts thereby to form a seal is installed in a lower portion of an air passage in the ventilation pipe which communicates to the outside atmosphere, and a stopper to stop the upward movement of the spherical body is installed in an upper portion of said air passage;

(3) The drain pipe ventilating apparatus according to the above apparatus (1) or (2), wherein the ventilation pipe connected to the predetermined point of the drain pipe has a guide means provided between an inner wall of the ventilation pipe and the spherical body so as to assist the spherical body in moving up and down, and the ventilation pipe that communicates to the outside atmosphere has a guide means provided between an inner wall of the ventilation pipe and the spherical body so as to assist the spherical body in moving up and down, while an inner sleeve that has the guide means is preferably fitted in each of these ventilation pipes so as to make the spherical body move up and down smoothly by means of the guide means or the inner sleeve; and (4) The drain pipe ventilating apparatus according to the above apparatus (3), wherein the guide means that assists the spherical body in moving up and down comprises an elongated member (such as a strip, rod or pillar) that extends in a vertical direction on a side surface of a cylinder having a diameter (such that the spherical body can theoretically move up and down in said cylinder without touching the cylinder) which is slightly larger than a diameter of an imaginary cylinder (a right cylinder having the same diameter as that of the spherical body) which corresponds to a trace formed by the spherical body moving up and down in the ventilation pipe, and three or more of the guide means are disposed at regular intervals on the surface of the cylinder and the stopper is preferably provided at one end of the guiding means.

It is noted that the guide means may be connected, at an upper end and a lower end thereof, to members that embody an upper end portion and a lower end portion of the imaginary cylinder (thus short cylindrical or ring-shaped members). This combination of the guide means and portion the upper end portion and lower end portion corresponds to the inner sleeve.

As used herein, the term "predetermined point of the drain pipe" refers to a certain point along the drain pipe which requires ventilation, and the point is in the downstream of an element that stores water or waste water to be drains such as a tank, a container, a wash basin and a toilet bowl. When a water seal is provided, it is preferable that the point is in the downstream of the water seal and it is as close to the element as possible. For example, the point is preferably just below such an element.

As used herein, the expression "when waste water passes the predetermined point of the drain pipe" means a time period from the time when draining of the water or waste water from the element as described above is started to the time when draining of the water or waste water from the element has been completed and the predetermined point of the drain pipe returns to the state prior to draining. Therefore, at a given point in the drain pipe, "when waste water passes the predetermined point of the drain pipe" means a time period from the time a little before the waste water passes the point to the time a little after the waste water has passed the point. An extent of "a little" depends on factors such as a drainage amount and conditions of the drain pipe.

As used herein, the term "force acting on the spherical body" refers to at least one of a gravity force (namely a weight of the spherical body), a positive pressure and a negative pressure generated upon draining and a force exerted by the waste water on the spherical body floating thereon to move it upward when a part of the waste water enters the ventilation pipe (particularly the air passage therein).

As used herein, the expression "the spherical body moves up and down in accordance to the force acting on the spherical body" means that the spherical body moves up and down according to balance of the forces that are acting on the spherical body among those forces (i.e. a magnitude and a direction of a resultant force of the acting forces) when the waste water passes The expression "the spherical body moves up and down" means that the spherical body moves in various sequences consisting of at least one of moving upward and moving downward (preferably in the vertical direction) and stopping (including staying at the same position), and such expression includes also staying stationarily and stopping after moving.

In other words, the drain pipe ventilating apparatus (or device) according to the present invention comprises:

a first ventilation pipe (or gas passing pipe or vent tube) and a second ventilation pipe (or gas passing pipe or vent tube) each having a spherical body which freely moves up and down therein wherein:

the first ventilation pipe has an opening at a lower end thereof to connect to a drain pipe at a predetermined point, the second ventilation pipe has an opening at a lower end thereof to serve as an air intake port (or a gas intake port), an upper end of the first ventilation pipe and an upper end of the second ventilation pipe are communicated with each other so that an air path (or a gas path) is formed from the lower end of the second ventilation pipe to the lower end of the first ventilation pipe, and the air path (or gas path) is opened and closed by at least one of the spherical bodies moving up and down in the ventilation pipe in accordance to a force acting on the spherical body, specifically due to at least one of a gravity force, a force caused by a pressure difference (a so-called differential pressure) between the inside and outside of the drain pipe ventilating apparatus and a level change of the waste water that enters the ventilation pipe.

Such drain pipe ventilating apparatus is characterized in that the spherical bodies provided in the two ventilation pipes can move up and down and, when the waste water passes the predetermined point of the drain pipe, at least one of the spherical bodies can actually move and in some case can stop afterward so that the air path can be opened and closed. In the drain pipe ventilating apparatus of the present invention, air is taken from the outside through the air intake port and supplied into the drain pipe when the air path is the open condition, while the water or the waste water and/or the odor of the waste water are effectively prevented from leaking to the outside when the air path in he closed condition. That is, the drain pipe ventilating apparatus of the present invention functions as a valve having the two spherical bodies which serve as valve elements, so that the air path is opened and closed when the spherical body of each ventilation pipe is seated on the valve seat and departs off the valve seat (namely, at a condition of the spherical body on the valve seat and at a condition of the spherical body off the valve sheet), respectively.

The spherical body moves up and down in the ventilation pipe in accordance to at least one of the gravity force, the force caused by the pressure difference (the so-called differential pressure) between the inside and outside of the drain pipe ventilating apparatus and the level change of the waste water that enters the ventilation pipe. In this specification, the pressure difference between the inside and outside of the drain pipe ventilating apparatus refers to the difference between the pressure of the atmosphere in which the drain pipe ventilating apparatus is placed (namely the atmospheric pressure or the pressure below the spherical body in the second ventilation pipe) and the pressure in the drain pipe ventilating apparatus (which may be, for example, the pressure above the spherical body in the second ventilation pipe or the pressure above the spherical body in the first ventilation pipe).

The term "spherical body" refers to a valve element that is seated on the valve seat disposed in the ventilation pipe so as to form an airtight and liquid-tight seal with the valve seat, at least a portion of the spherical body that makes contact with the valve seat is formed to be a portion of a spherical surface, and the spherical body does not experience such deformation by the force acting thereon as the seal becomes insufficient. Accordingly, the valve seat has a portion that is complementary to a portion of the spherical surface of the spherical body that forms the seal and has an opening at the center thereof so as to form a portion of the air path. In one embodiment, the valve seat is a ring-shaped member that has a circular opening (an inner diameter of which is smaller than the diameter of the spherical body) which surrounds a portion of the spherical body so as to form the seal. The valve seat may have a seal forming member for the improvement of tight contact with the spherical body, in which case the spherical body is a valve element a portion of which is in contact with the seal forming member and such portion forms a portion of a spherical surface. The seal forming member may be for example a packing having a ring shape made of an elastic material (for example, O-ring (particularly made of a vinyl chloride, a silicone, Viton or the like)).

While the spherical body preferably has a substantially spherical shape, the shape may not be substantially spherical as long as a sufficient seal can be formed in combination with the valve seat. In this sense, provided that the portion that makes contact with the valve seat is a portion of a spherical surface, the other portion may not be spherical. The term spherical is used in such sense in the present specification. Accordingly, the spherical body may be a cylindrical body having a spherical end surface or may be a semi-sphere. The spherical body may be either hollow or solid and, in other embodiment, may have a hollow portion in a part thereof. The spherical body can be selected appropriately according to the force that acts on the spherical body.

In the ventilation apparatus of the present invention, since the spherical body is caused to move up and down in each ventilation pipe by using at least one of the gravity force, the force caused by the pressure difference (the so-called differential pressure) between the inside and outside of the drain pipe ventilating apparatus and the level change of the waste water that enters the ventilation pipe, in general the spherical body is desirably light in its weight. In case the spherical body is a sphere in its shape, the spherical body is preferably so light (like a float) that a water line is preferably below a horizontal plane which includes a center line of the spherical body when it is floating on the water (namely the distance between the lowest bottom portion of the sphere and the water level) is not larger than a half of the diameter of the sphere, preferably not larger than one third (for example, about a quarter) and more preferably less than one fifth of the diameter. Specifically, a plastic spherical body formed to be hollow (such as a Ping-Pong (table tennis) ball) is preferably used as the spherical body A sphere made of a foamed material having closed cells (such as foamed styrol) may also be preferably used.

The first ventilation pipe and the second ventilation pipe are cylinders each having a hollow portion extending from its upper end to its lower end. The spherical body moves up and down in the hollow portion, thus the hollow portion serves as a path for the spherical body. In the first ventilation pipe and the second ventilation pipe, a cross section of the hollow portion is preferably circular (that is, the hollow portion is cylindrical), but it may has other shape like a polygon such as triangle and rectangle as long as the spherical body can be freely move up and down therein. Particularly in case wherein the guide means or the inner sleeve is provided, since the guide means or the inner sleeve substantially defines the path for the spherical body, the cross section of the hollow portion may have other shape. In one preferable embodiment, a space between the spherical body inserted in the ventilation pipe and the inner surface of the ventilation pipe is as small as possible to such an extent that the flow of gas through the ventilation pipe is not excessively hindered, and the space is similarly made as small as possible also when the guide means or the inner sleeve is provided between the spherical body and the inner surface of the ventilation pipe. Concretely, when the ventilation pipe has the cylindrical hollow portion, the diameter of the hollow portion is a little larger than the diameter of the spherical body.

The lower end of the first ventilation pipe is connected to the drain pipe at the predetermined point so as to communicate between the drain pipe ventilating apparatus and the drain pipe. The lower end of the second ventilation pipe functions as the air intake port. The air intake port is to introduce the outside air into the drain pipe ventilating apparatus, and it may also be called the vent hole. Communication between the first ventilation pipe and the second ventilation pipe is established at the upper ends thereof. Therefore, the drain pipe ventilating apparatus has the air path formed to run from the lower end (namely the air intake port) of the second ventilation pipe, through the upper end of the second ventilation pipe, the communicating air path between the second ventilation pipe and first ventilation pipe and the upper end of the first ventilation pipe, to the lower end (namely the drain pipe) of the first ventilation pipe.

The expression "comprises the first ventilation pipe and the second ventilation pipe" means that the spherical bodies can move up and down in the different ventilation pipes respectively in the drain pipe ventilating apparatus of the present invention. This does not necessarily mean that the first ventilation pipe and the second ventilation pipe have to be separate members. For example, the drain pipe ventilating apparatus of the present invention may be constituted from an integral ventilation pipe consisting of the first ventilation pipe and the second ventilation pipe which are connected together at the upper ends thereof (for example, an inverted U-shaped ventilation pipe). Alternatively, an integrally formed member having two cylindrical portions may be used. In any of these embodiments, the first ventilation pipe and the second ventilation pipe are disposed in parallel preferably vertically.

The expression that "the upper end of the first ventilation pipe and the upper end of the second ventilation pipe are communicated with each other" means that a fluid (particularly a gas, for example air) that flows out of the upper end of the first ventilation pipe can flow into the second ventilation pipe through the upper end thereof, and also that the fluid that flows out of the upper end of the second ventilation pipe can flow into the first ventilation pipe through the upper end thereof.

The communication between the first ventilation pipe and the second ventilation pipe can be made in various modes. For example, each of the upper ends of both ventilation pipes may be opened in a common closed space, which is used as a communicating portion which communicates the both ventilation pipes with each other. Such a space can be formed by covering the upper ends of both ventilation pipes with a deep dish (for example, a petri dish). Alternatively, the first ventilation pipe and the second ventilation pipe may be disposed adjacent to each other with a communication passage as the communicating portion which is provided so as to connect the upper portions of the both ventilation pipes at a position higher than the top of the spherical body seated on the valve seat in the first ventilation pipe.

When the waste water is not flowing in the drain pipe and the pressure in the drain pipe is almost equal to the atmospheric pressure, each of the spherical bodies on which the gravity forces are acting is kept stationary by a proper member (for example the valve seat or the stopper) so as not to move downward further more, and the spherical body is seated (namely, abutting to the valve seat) in the second ventilation pipe, so as to prevent the gas in the drain pipe from leaking to the outside.

The movement of the spherical body in the vertical direction in the first ventilation pipe is achieved by the level change of the waste water that flows from the drain pipe into the first ventilation pipe. That is, the spherical body in the first ventilation pipe floats on the waste water surface when the waste water flows from the drain pipe into the first ventilation pipe, and then moves up or down as the water level in the first ventilation pipe changes. The entry of the waste water into the first ventilation pipe can occur, for example when the waste water flowing through the drain pipe hits an inner wall of the drain pipe and splashes at for example a bend of the drain pipe (particularly at a tee-joint portion), or an excessive quantity of the waste water flows through the drain pipe, or when the drain pipe is temporarily clogged. In the second ventilation pipe, the spherical body moves upward or downward according to the gravity force acting on the spherical body and the pressure difference between the inside and outside of the drain pipe ventilating apparatus (namely, the difference between the atmospheric pressure and the negative pressure) during the passage of the waste water at the predetermined point of the drain pipe.

The mechanism to open and close the air path of the drain pipe ventilating apparatus becomes extremely simple by employing such a constitution that the spherical body that is the valve element is moved up or down by making use of at least one of the gravity force, the force caused by the pressure difference between the inside and the outside of the drain pipe ventilating apparatus and the level change of the waste water that enters the ventilation pipe.

In the drain pipe ventilating apparatus of the present invention, the air path is substantially closed when the spherical body is seated on the valve seat. The drain pipe ventilating apparatus of the present invention has the valve seat for the spherical body that moves up and down in the first ventilation pipe preferably located on an upper end side of the first ventilation pipe as well as the valve seat for the spherical body that moves up and down in the second ventilation pipe preferably located on a lower end side of the second ventilation pipe. In the case in which the valve seats are provided in such an arrangement, the spherical body in the first ventilation pipe is seated on the valve seat by moving upward as the water level rises while floating on the waste water that has entered from the drain pipe. When the spherical body is seated in this way, the seal formed by the spherical body and the valve seat in the first ventilation pipe prevents further entry of the waste water if the waste water enters from the drain pipe into the first ventilation pipe. However, since there is a gas above the waste water that has entered the first ventilation pipe and the spherical body has already been seated with seal being formed in the second ventilation pipe, rising of the water level in the first ventilation pipe compresses the gas in the ventilating apparatus so as to increase the pressure therein, and therefore the waste water cannot easily move up in the first ventilation pipe. In other words, leak of the waste water to the outside of the ventilating apparatus is effectively prevented by dual means in the drain pipe ventilating apparatus of the present invention, that is by the increase of the pressure in the air path between the seal formed by the spherical body that has been seated on the valve seat in the second ventilation pipe and the surface of the waste water which enters, and also by preventing the progress of the waste water by means of the seal formed by the spherical body that has been seated on the valve seat in the first ventilation pipe.

In the drain pipe ventilating apparatus of the present invention, the seal is formed at the lower end of the second ventilation pipe by the spherical body which is seated at the lower end in the second ventilation pipe due to the gravity force except when a negative pressure is generated in the drain pipe due to the drainage of the water or the waste water. That is, the air path of the drain pipe ventilating apparatus of the present invention is always closed except during draining. In such a constitution, the leakage of odor which is generated in the drain pipe can be effectively prevented at all the time.

In order to easily ensure liquid tight and airtight seal formed between the valve seat and the spherical body, the seal forming member made of the elastic material is preferably provided on the valve seat as described above. When the seal forming member is provided on the valve seat, the spherical body that is to be seated on the valve seat makes contact with the seal forming member. As the seal forming member, a member called a packing may arbitrarily be used The packing may be an O-ring or the like made of an elastic material (particularly, a vinyl chloride, a silicone, Viton or the other rubber).

The drain pipe ventilating apparatus of the present invention has preferably a stopper located on the side opposite to the valve seat with respect to the spherical body so as to prevent the spherical body from moving up or down beyond the predetermined position. The stopper is provided on the side of the end where the valve seat is not provided in the ventilation pipe. The stopper has such a structure that the air path is not closed even when the stopper makes contact with the spherical body, so that the air path is ensured. The stopper may comprise a plurality of projections, for example claw-like members, provided so as to protrude inward at intervals on, for example, the ring-shaped member.

The drain pipe ventilating apparatus of the present invention preferably has an inner sleeve having the guide means in the ventilation pipe which means assists the spherical body in moving up and down. The inner sleeve assists the spherical body in moving up and down as desired. The expression that "the spherical body moving up and down as desired" means to limit horizontal movement of the spherical body so that the spherical body moves up and down without making contact with the inner surface of each of the ventilation pipe, namely the spherical body is moved up and down through correct path so as to properly be seated without positional deviation (without the so-called play of the ball). For whichever the purpose the inner sleeve is provided, the inner sleeve has such a structure that the passage of air between the spherical body and the inner surface of the ventilation pipe is not obstructed in each ventilation pipe when the spherical body is not seated on the valve seat.

The inner sleeve is a cylindrical member having a diameter larger than, preferably a little larger than the diameter of the spherical body, and preferably has a window(s) (or an opening(s)) on the side surface thereof in order to maintain the air passage. Such an inner sleeve can be formed, for example, from a mesh. The mesh may be made of, for example, a plastic or a metal.

In other embodiment, the inner sleeve is constituted by forming a plurality of pillars spaced on the periphery of a ring with the pillars being perpendicular to the ring circle. The inner sleeve of this constitution has a cage-like appearance. The pillars are preferably supported by a proper member, which may be, for example, a ring-shaped member that supports the pillars at the top or the bottom thereof. In this inner sleeve, the pillars function as guide means that assists the spherical body in moving up and down, while the space between the pillars serves as the window to ensure the passage of air. Three or more pillars are preferably disposed. The pillars are preferably disposed at equal intervals along the circumference of the ring-shaped member so that the distances between the pillars are the same.

In the case in which the inner sleeve is constituted from the pillars, the stopper may be provided on one end side of the pillars. When the stopper is provided on the pillars, the inner sleeve is disposed in each ventilation pipe so that the stopper is located on the end side opposite to the end side that is adjacent to the valve seat.

The drain pipe ventilating apparatus of the present invention is characterized in that it prevents the leakage of the gas or the liquid, particularly the leakage of the liquid from the drain pipe to the outside by surely closing the air path in the double manners by using the two spherical bodies, so that no water or waste water is allowed to leak from the air intake port even when the vent hole is not installed at a high position as in the ventilation pipe of the prior art. Moreover, since the drain pipe ventilating apparatus of the present invention effectively prevents the leak of odor, too, the air intake port may be installed indoors. Thus the drain pipe ventilating apparatus of the present invention can be installed easily at a desired position of the drain pipe without using s ventilation pipe that has a vent hole at a high position, and does not require to make holes in the floor, the wall, the ceiling and the like. Thus the work period for installing the drainage system can be greatly reduced and the installation cost can be greatly reduced.

The drain pipe ventilating apparatus of the present invention can be connected conveniently to various drain pipes by using joints or the like, and does not require adjustment at the construction site. Accordingly, a large number of the drain pipe ventilating apparatuses of the present invention can be produced and stored, so that they can be quickly supplied depending on demands on-site.

Since the drain pipe ventilating apparatus of the present invention does not substantially require the ventilation pipes that are employed in the drainage systems of the prior art, a broader space can be ensured for the other facilities and/or piping. Furthermore, since the ventilation pipes and the vent hole are not exposed on the inner wall or the external wall of the building, the appearance of the interior and the exterior of the building is not adversely affected.

BRIEF DESCRIPTION OF THE DRAWINGS

FIG. 8 schematically shows an example of the drainage system of the prior art; and FIG. 9 is a longitudinal sectional view schematically showing the ventilation valve for the drain pipe of the prior art.

Figure 1:
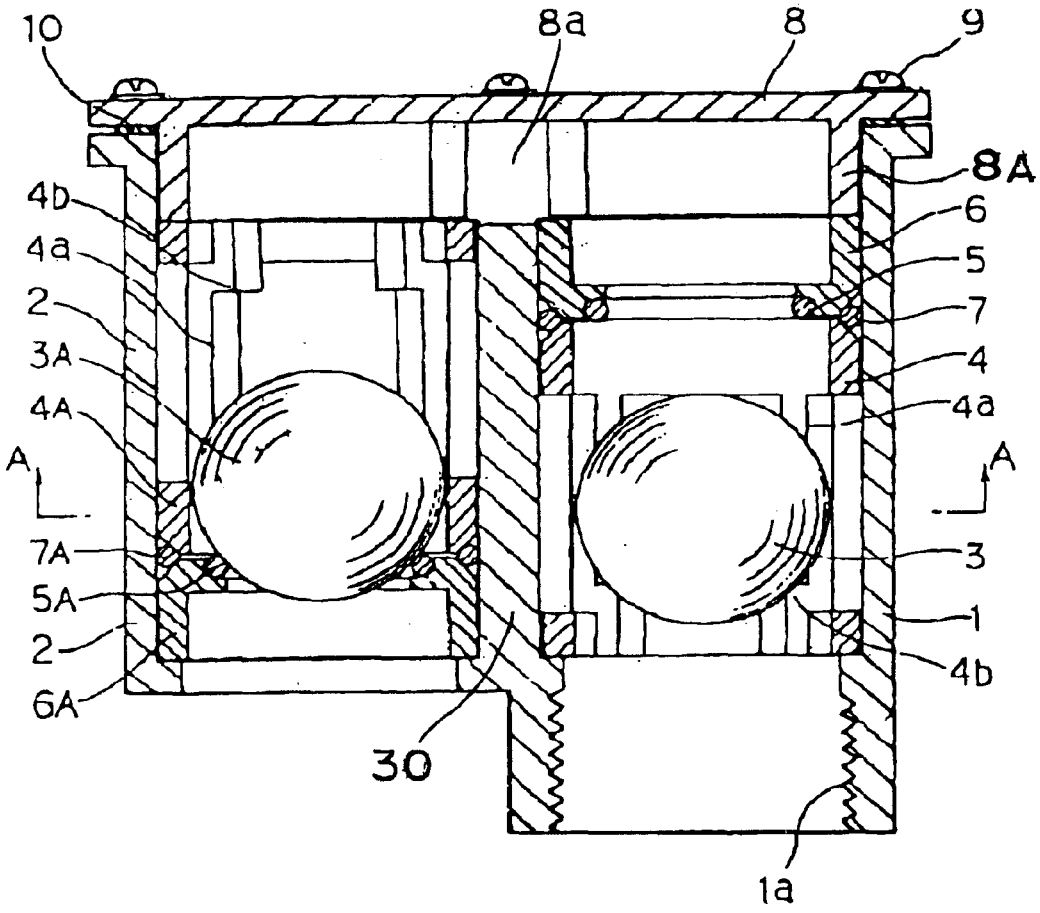
FIG. 1 is a longitudinal sectional view schematically showing one embodiment of the drain pipe ventilating apparatus according to the present invention.

Reference numerals in the drawings denote the following elements:

1, 2: Ventilation pipe
1*a*: Screw
3, 3A: Spherical body
4, 4A: Inner sleeve
4*a*: Pillar (guide means)
4*b*: Stopper
4*c*: Ring-shaped member
4*d*: Window
6, 6A: Valve seat
8: Lid
8A: Pressing frame
8*a*: Communicating path
9: Screw
10: Packing
11: Drain pipe or joint
30: Wall
100: drain pipe ventilating apparatus
12: Container
13, 15: Drain pipe
14: Kitchen sink
16, 17, 19, 20: Ventilation pipe
18: Vent hole
21: Air passage valve
22: Funnel-shaped valve seat
23: Ball

EMBODIMENTS TO CARRY OUT THE INVENTION

Figure 2:
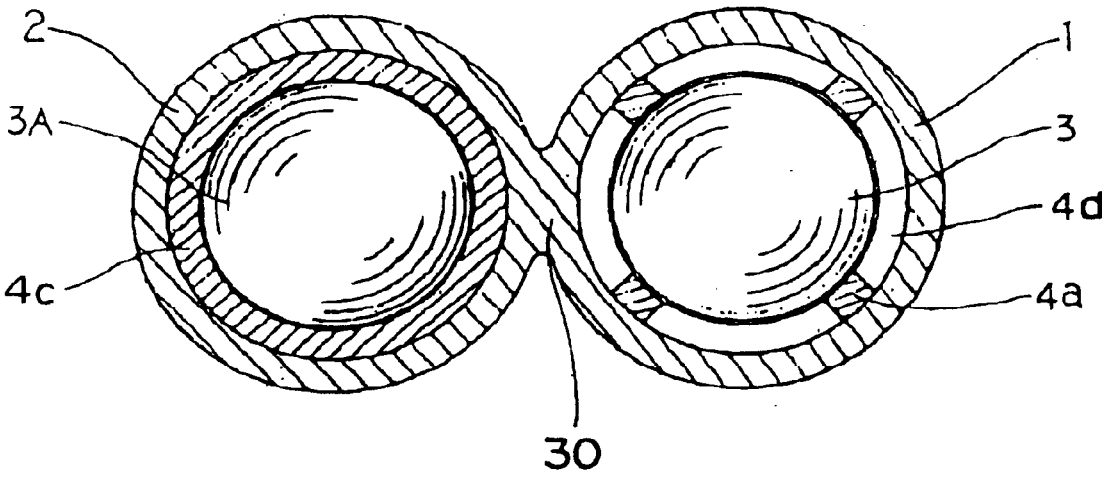
FIG. 2 is a transverse cross sectional view of the drain pipe ventilating apparatus according to the present invention taken along a line A—A in FIG. 1.

Preferred embodiments of the present invention will be described below with reference to FIG. 1 and FIG. 2. FIG. 1 and FIG. 2 show the ventilation apparatus of the present invention connected to the drain pipe (not shown) at the predetermined point, in a state prior to the start of draining or an amount of the waste water being flowing is small so that no force other than the gravity substantially acts on the spherical body. In the drain pipe ventilating apparatus shown in FIG. 1 and FIG. 2, the first ventilation pipe (1) and the second ventilation pipe (2) are disposed vertically in parallel to each other and are separated from each other by a common partition (30).

Each of the ventilation pipes (1, 2) has the spherical body (3, 3A) inserted therein to be movable up and down. The spherical bodies (3, 3A) are hollow balls made of a plastic material, and such body floats on the water surface with its center being located above the water level, namely, more than a half and preferably three fourths of the volume of the sphere emerges above the water surface.

The lower end of the first ventilation pipe (1) is an opening which is to be connected to the drain pipe at the predetermined position, and the lower end of the second ventilation pipe (2) is an opening that serves as the air intake port. In the embodiment shown in the drawing, the inner surface of the first ventilation pipe (1) at its lower end has a threaded portion (1*a*) so as to engage with the drain pipe (or a joint connected to the drain pipe). The lower end of the first ventilation pipe (1) and the drain pipe (or the pipe joint connected to the drain pipe) may be connected by means of a union joint. The lower end of the first ventilation pipe (1) and the drain pipe (or the pipe joint) may also be connected by means other than the thread, for example an adhesive for piping, in which case the inner surface of the first ventilation pipe (1) may be smooth.

Attached to flanges located at the tops of the both ventilation pipes (1, 2) is a lid (8) substantially air-tightly and liquid-tightly via a packing (10) by means of screws (9). In this embodiment, the space below the lid (8) corresponds to the communicating portion, and this embodiment corresponds to the embodiment in which the upper ends of the both ventilation pipes are open to the common closed space.

The first ventilation pipe (1) has the inner sleeve (4) inserted therein that has the guide means (4*a*) to assist the spherical body (3) in moving up and down as desired. The inner sleeve (4) has a ring seat (namely an annular shaped valve seat) (6) having an O-ring (5) placed thereon as a packing, which O-ring (5) is attached via an O-ring (7) on the top end of the inner sleeve (4). The ring seat (6) has an opening at the center thereof to allow ventilation. The opening is closed when the spherical body is seated on the seat.

The second ventilation pipe also has the inner sleeve (4A) inserted therein. The inner sleeve (4A) has a ring seat (namely an annular shaped valve seat) (6A) having an O-ring (5A) placed thereon as a packing, which O-ring (5A) is attached via an O-ring (7A) on the lower end of the inner sleeve (4A). The ring seat (6A) has an opening at the center thereof to allow ventilation. The opening is closed when the spherical body is seated on the seat.

In the embodiment shown in the drawing, the lid (8) has a pressing frame (8A). When the lids (8) are attached to the ventilation pipes with screws (9), a lower end of the pressing frame (8A) presses the ring seat (6) against the inner sleeve (4) in the first ventilation pipe, and presses the inner sleeve (4A) against the ring seat (6A) in the second ventilation pipe. This causes the O-rings (7, 7A) to deform elastically so as to ensure that the gas or liquid can pass only through the openings of the ring seats (6, 6A). That is, the O-rings (7, 7A) maintains the seal between the peripheries of the ring seats and the inner surfaces of the ventilation pipes.

The pressing frame (8A) is provided so as to substantially be along with the circumference of the two ventilation pipes, thereby defining the depth of the lid. The lid (8) forms a space having a height that corresponds to the height of the pressing frame (8A) above each ventilation pipe. The pressing frame (8A) does not exist in the portion of the lid (8) where the first ventilation pipe and the second ventilation pipe are in contact. The portion where the pressing frame (8A) does not exist forms the communicating path (8*a*) so as to establish the communication between the upper ends of the ventilation pipes (1, 2).

Thus in the apparatus of the present invention, the air path between the first ventilation pipe (1) and the second ventilation pipe (2) is formed which extends from the opening of the first ventilation pipe (1) that is connected to the drain pipe at the predetermined position to the lower end of the second ventilation pipe (2) that serves as the air intake port.

Figure 3:
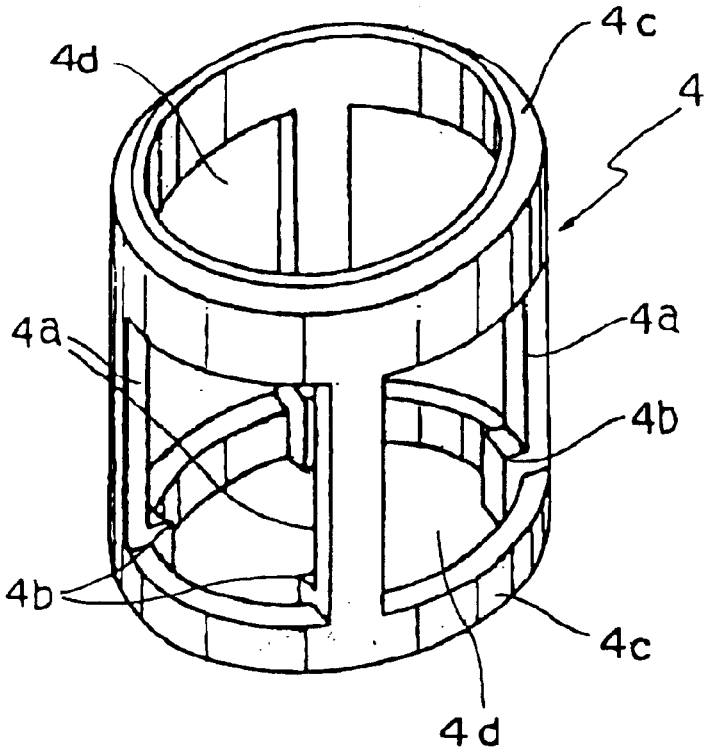
FIG. 3 is a perspective view schematically showing one embodiment of the inner sleeve.

FIG. 3 is a perspective view of the inner sleeve (4) used in the embodiment shown in FIG. 1. The inner sleeve (4A) corresponds to the inner sleeve (4) shown in FIG. 3 inverted up side down. The inner sleeve (4) includes four strip-shaped pillars (4*a*) as the guide means, the pillars (4*a*) being supported at the upper ends and lower ends thereof by ring members (4*c*). The pillars (4*a*) are disposed at equal intervals along the circumference of the ring members, so that windows (4*d*) are formed between the adjacent pillars that allow air to pass, while the pillars form a cylinder as a whole. An inner diameter of the inner sleeve (4) is slightly larger than the diameter of the spherical bodies (3, 3A) (for example, larger by about 0.5 to 2 mm in the case of spherical body having a diameter of 40 mm)

The pillar (4*b*) has the claw-like stopper (4*b*) protruding at the lower end thereof. In the mode shown in the drawing, the stopper (4*b*) is provided above the upper end of the lower ring member (4*c*) so as to protrude inward therefrom (namely, toward the center of a circle formed by the ring member), and therefore a sufficient passage of air flow is ensured even when the spherical body (3) is in contact with the stoppers (4*b*). As shown in FIG. 1, the stoppers (4*b*) are located at a lower position in the first ventilation pipe so as to determine the position of maximum descent of the spherical body (3), and also the stoppers (4*b*) are located at an upper position in the second ventilation pipe so as to determine the position of maximum ascent of the spherical body (3A).

FIG. 1 shows a situation in which the spherical bodies (3, 3A) are stationary while the gravity forces only are acting on the bodies, with the spherical body (3A) seated in the second ventilation pipe (2) so as to close the air path. As a result, a cross-section taken along the line A—A in FIG. 1 corresponds to FIG. 2. In the first ventilation pipe (1), the stopper (4*b*) prevents the spherical body (3) from moving down further. In the second ventilation pipe, the spherical body (3A) is seated on the ring seat (6A) via the O-ring (5A), and forms a small gap between itself and the ring member (4*c*) of the inner sleeve (4A).

Figure 4:
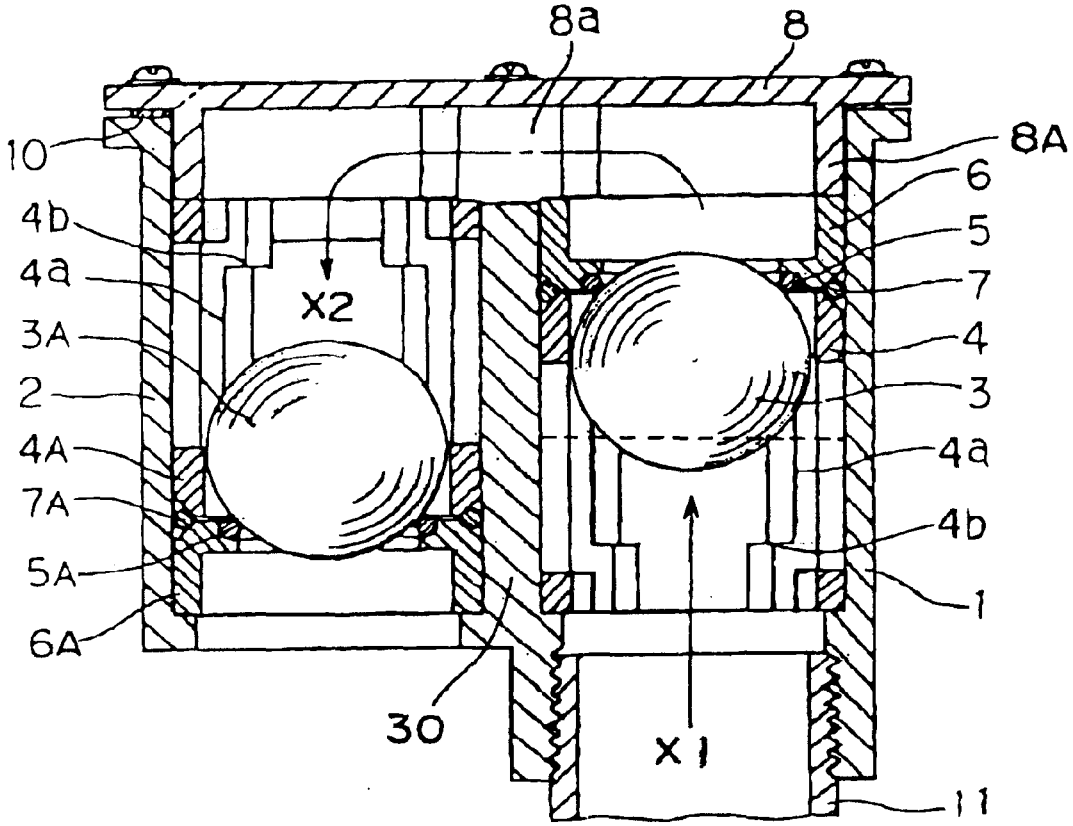
FIG. 4 is a longitudinal sectional view schematically showing a state of the drain pipe ventilating apparatus shown in FIG. 1 where the spherical body is seated on the vale seat when the waste water level rises in the first ventilation pipe.
Figure 5:
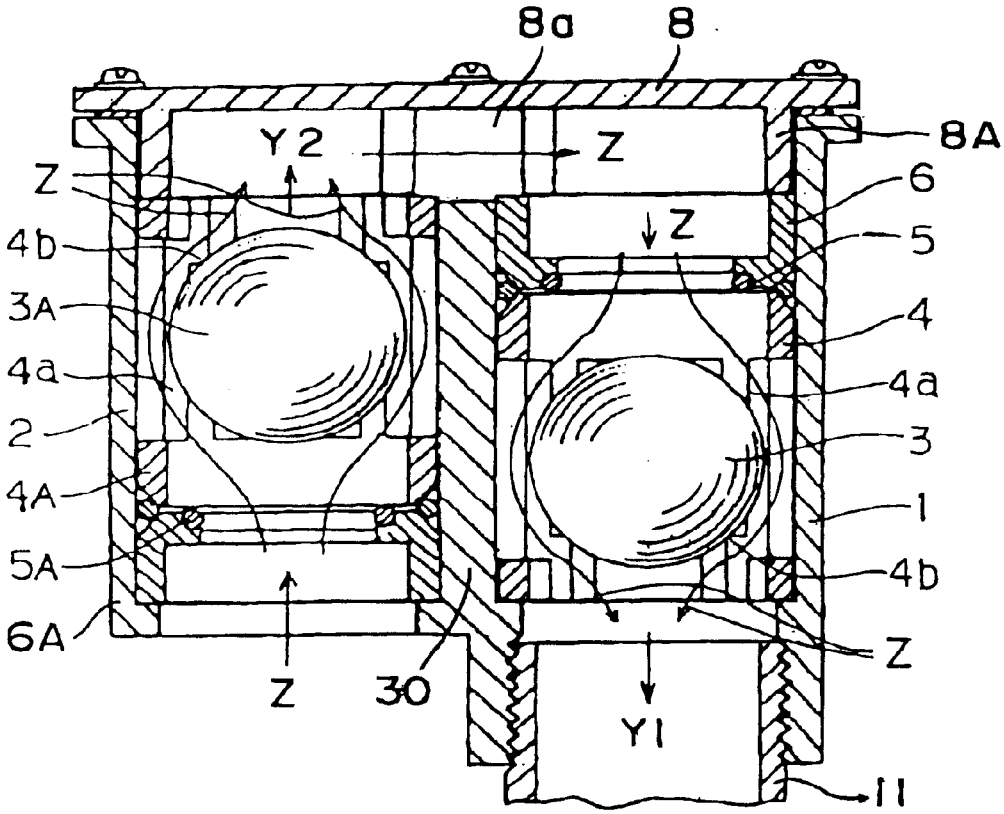
FIG. 5 is a longitudinal sectional view schematically showing a state of the drain pipe ventilating apparatus shown in FIG. 1 where the air path is opened so that the outside air flows into the drain pipe.

Now, the up and down movements of the spherical bodies (3, 3A) and air flow in the drain pipe ventilating apparatus of the present invention connected to a drain pipe will be described below with reference to FIG. 4 and FIG. 5. FIG. 4 and FIG. 5 show the up and down movements of the spherical bodies (3, 3A) and the air flow that can be observed when the lower end of the first ventilation pipe (1) is connected to the drain pipe (or the pipe joint connected to the drain pipe) (11) and the water or waste water is drained in a flash by making use of the level difference.

FIG. 4 shows a state in which a part of the waste water flowing in the drain pipe has entered the first ventilation pipe (1) (only the water level of the waste water is indicated with the broken line without showing the waste water itself). The waste water enters the first ventilation pipe, for example, when the waste water flowing in the drain pipe hits the inner surface of the drain pipe and splashes, or the drain pipe is temporarily clogged thereby to increase the water level in the drain pipe. When waste water enters the first ventilation pipe (1), the spherical body (3) floats on the water due to a buoyant force acting in the direction of the arrow X1. Thereafter, while floating on the water, the spherical body (3) moves up when the water level rises and moves down when the water level lowers.

The spherical body (3A) in the second ventilation pipe is seated due to its weight on the ring seat (6A) via the O-ring (5A), thereby to form seal. Such seal is formed regardless of whether or not seal is formed in the first ventilation pipe, thereby to suppress rising of the water level in the first ventilation pipe. Specifically, when the spherical body (3) moves up in the first ventilation pipe, the air in the space between the spherical body (3) and the spherical body (3A) is compressed as the spherical body (3) rises so that a force acts on the spherical body (3A) in the direction of arrow X2. The force in the direction X2 presses more strongly the spherical body (3A) against the ring seat (6A) via the O-ring (5A) thereby to ensure further sufficient seal at the lower end of the second ventilation pipe (2). As the air in the space between the spherical body (3A) and the water surface is compressed to increase the pressure, the water level in the first ventilation pipe is prevented from rising by this pressure.

When an amount of air existing below the spherical body (3) is less than an amount of air existing in the other portion of the ventilation apparatus, the waste water level may rise and compress the air in the apparatus so as to force the spherical body (3) to be seated on the valve seat, if a large head pressure is acting on the waste water that has entered. Also, in the case wherein the spherical body (3A) is not properly seated on the valve seat (that is, gas is leaking through a part of the seal) for some reason (for example, deposition of a foreign matter), the air in the apparatus may be discharged to the outside by the rising water level, resulting in easily rising waste water level and eventually causing the spherical body (3) to be seated on the valve seat. Such a situation is schematically shown in FIG. 4.

In FIG. 4, the spherical body (3) is seated on the ring seat (6) via the O-ring (5). When the spherical body (3) is seated, the seal is formed between the spherical body (3) and the ring seat (6) so that no further rising of the water level occurs.

Since the spherical body (3) is such that its water line is not above the center of the spherical body, the water level in the first ventilation pipe does not locate above over the spherical body (3) while the spherical body (3) is moving up. Therefore, the water never flows over the upper end of the first ventilation pipe (1) before the spherical body (3) is seated.

Accordingly, when the waste water enters from the drain pipe into the drain pipe ventilating apparatus of the present invention, leakage of the waste water to the outside of the apparatus is surely prevented by dual stages of the spherical body in the first ventilation pipe and the spherical body in the second ventilation pipe.

The seal formed at the lower end of the second ventilation pipe (2) prevents the leakage of the air from the first ventilation pipe (1) and the second ventilation pipe (2), and therefore prevents the leakage of the air from the drain pipe. As a result, when such air includes odor, emission of the odor is prevented very effectively.

The leakage of the air as described above is effectively suppressed also in the situation as shown in FIG. 1.

FIG. 5 shows such a situation as a negative pressure is generated by draining after the situation shown in FIG. 1 or FIG. 4, so that an upward force in the direction of the arrow Y2 acts on the spherical body (3A) in the second ventilation pipe (2) which force is generated by the pressure difference between the outside and the inside of the ventilation apparatus, namely the pressure difference between the inside of the apparatus and the atmospheric pressure. When this force acting upward exceeds the weight of the spherical body (3A), the spherical body (3A) cannot be in the seated condition on the valve seat and moves upward. An extent of the upward movement of the spherical body (3A) is determined by the negative pressure and the weight of the spherical body. However, when the spherical body (3A) abuts to the stopper (4*b*), it cannot move further upward. In this situation, the spherical body (3) in the first ventilation pipe (1) abuts to the stopper (4*b*) due to its weight (and therefore not seated on the valve seat), so that the air path is opened. That is, since both the spherical bodies (3, 3A) are not seated on the ring seats (6, 6A) (namely, they are not in contact with the O-rings (5, 5A)), the air path is in the open condition.

Since the pressure in the drain pipe (11) is negative in the joint with the first ventilation pipe, the air in the drain pipe ventilating apparatus is sucked in the direction of arrow Y1, so that the outside air is taken through the air intake port into the ventilation apparatus. That is, when the air path is in the open condition, since the pressure in the drain pipe ventilating apparatus is lower than the atmospheric pressure, the air is necessarily taken into the apparatus through the lower end of the second ventilation pipe. The air that has been taken in passes through the opening of the ring seat (6A) of the second ventilation pipe (2), the inside of the second ventilation pipe, the communicating path (8*a*), the opening of the ring seat (6) and the inside of the first ventilation pipe (1) so as to be supplied into the drain pipe (11) through the lower end of the first ventilation pipe. In each of the ventilation pipes (1, 2), the air passes through the windows between the pillars (4*a*) of the inner sleeve (4A) on the side of the spherical body (3, 3A). When the spherical bodies (3A) abuts to the stopper (4*b*), the air passes through the gap between the spherical bodies (3A) and the inner sleeve (4A). Such air flow is indicated by the arrows Z in FIG. 5. The air supplied into the drain pipe restores the pressure in the drain pipe from the negative to substantially the atmospheric pressure so as to prevent the water seal from being broken.

When the air is sucked in as shown in the drawing, the air and the waste water (if any) which have been present in the drain pipe ventilating apparatus flow into the drain pipe together with the former air, and then they are exhausted together with the water or waste water. Therefore, even when the air or the waste water emits odor, the odor does not leak through the vent hole to the outside.

When draining has been completed, the spherical bodies (3, 3A) get in the situation shown in FIG. 1 due to their weights, such situation is maintained until the next draining is carried out. When the drain pipe ventilating apparatus is in this situation, the odor in the drain pipe is effectively prevented from leaking to the outside by the seal formed between the spherical bodies (3A) and the ring seat (6A) via the O-ring (5A).

With the drain pipe ventilating apparatus of the present invention, as described above, when a negative pressure which is lower than a predetermined value (concretely, a negative pressure sufficient to move the spherical body upward in the second ventilation pipe) is generated in the drain pipe, the outside air is quickly supplied so as to prevent the pressure in the drain pipe from excessively decreasing and thus to suppress the occurrence of the siphoning phenomenon that causes the breakage of the water seal. Moreover in the ventilation apparatus of the present invention, when the gap between the inner surface of the second ventilation pipe and the spherical body is narrow as shown in FIG. 5, gas passes through such narrow gap so that the spherical body more easily moves upward even with a lower negative pressure than in the case of floating the ball over the funnel-shaped valve seat as shown in FIG. 9, which achieves higher sensitivity of the ventilation apparatus to the negative pressure.

A shape and dimensions of the drain pipe ventilating apparatus of the present invention can be optionally selected according to the diameter of the drain pipe and other factor. Typically, the first ventilation pipe and the second ventilation pipe have sizes of 4 to 5 cm in an inner diameter and 7 to 8 cm in a length, while the spherical body has a diameter of 3 to 4 cm.

Figure 6:
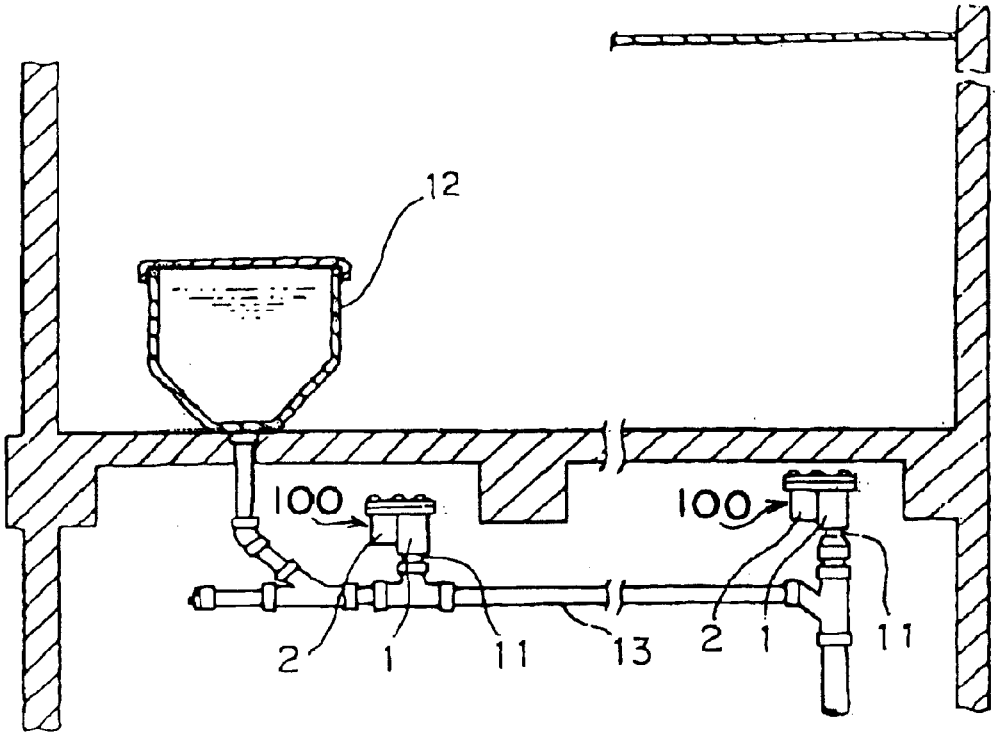
FIG. 6 schematically shows a drainage system where the drain pipe ventilating apparatus of the present invention is installed on the drain pipe.
Figure 7:
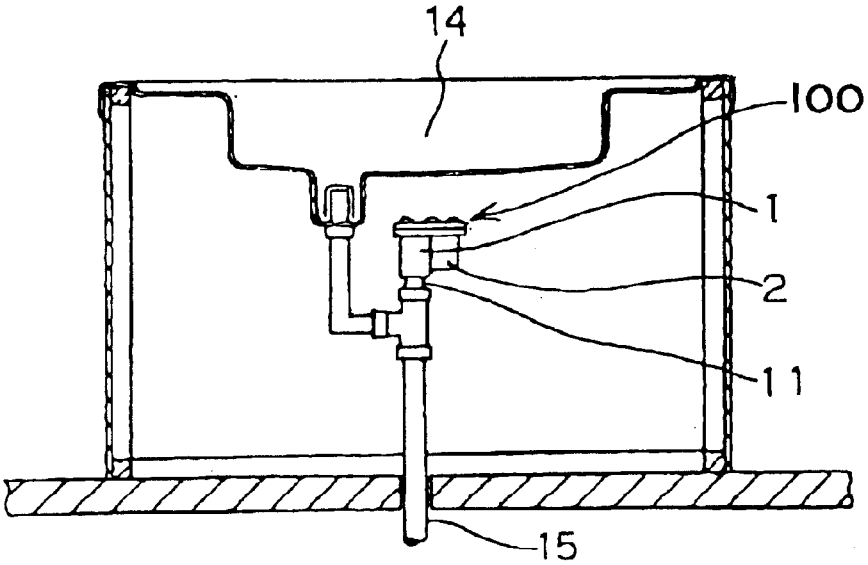
FIG. 7 schematically shows a drainage system where the drain pipe ventilating apparatus of the present invention is installed on the drain pipe of a kitchen sink.

FIG. 6 and FIG. 7 schematically show embodiments in which of using the drain pipe ventilating apparatus of the present invention is used.

FIG. 6 shows a drainage system that drains water or waste water stored in a vessel, herein a container (12) by making use of the level difference. The ventilation apparatuses (100) of the present invention are installed on the drain pipe (13) at predetermined positions (two positions) through joints (11). The joint (11) is connected to the lower end of the first ventilation pipe (1). As shown in the drawing, the ventilation apparatus of the present invention is preferably disposed immediately near a vessel, herein the container (12), that stores the water to be drained.

FIG. 7 shows an embodiment in which the drain pipe ventilating apparatus of the present invention is installed on a drain pipe (15) from a kitchen sink (14) by using the joint (11).

The size of the drain pipe ventilating apparatus (100) can be made in small, and therefore it can be conveniently accommodated in a space below the kitchen sink (14).

Since the drainage system shown in FIG. 6 and FIG. 7 are not provided with a ventilation pipe having a vent hole located at a high position, the drainage system has a simple design as a whole.

INDUSTRIAL APPLICABILITY

In the drain pipe ventilating apparatus of the present invention, the air path is opened and closed by moving at least one of the spherical body up and down while making use of at least one of the gravity force acting on the spherical body, the force caused by the pressure difference between the inside and outside of the drain pipe ventilating apparatus and the level change of the waste water that flows in from the drain pipe. This apparatus can be easily installed at a proper position of the drain pipe by means of joint or the like as required. As such, the apparatus can be applied to various drainage systems such as a kitchen, a washroom, a bath room and a lavatory of a residential house and a drainage system of a large building.

The ventilation apparatus of the present invention can be applied not only to the drain pipes but also to the other pipes that transport the other liquids, and can also be used as a ventilation apparatus for a vessel including a tank or the like. Concretely, the lower end of the first ventilation pipe is communicated to a gas phase located above the liquid surface in the tank and, for example when the liquid level in the tank lowers, outside air can be quickly supplied to the space above the liquid surface. As a result, the pressure of the gas phase in the tank can be effectively prevented from decreasing excessively.

What is claimed is:

1. A ventilating apparatus to supply a gas to a conduit which apparatus comprises a first ventilation pipe and a second ventilation pipe each having a spherical body which freely moves up and down therein wherein the first ventilation pipe has an opening at a lower end thereof to connect to the conduit at a predetermined point, the second ventilation pipe has an opening at a lower end thereof to serve as an intake port for the gas to be supplied, an upper end of the first ventilation pipe and an upper end of the second ventilation pipe are communicated with each other so that a gas path is formed from the lower end of the second ventilation pipe to the lower end of the first ventilation pipe, the gas path being opened and closed by at least one of the spherical bodies moving up and down in the ventilation pipe in accordance to a force acting on the spherical body, a valve seat for the spherical body moving up at an upper end side of the first ventilation pipe, a stopper for the spherical body moving down at a lower end side of the first ventilation pipe, a valve seat for the spherical body moving down at a lower end side of the second ventilation pipe, and a stopper for the spherical body moving up at an upper end side of the second ventilation pipe, wherein when at least one spherical body is seated on the valve seat, the gas path is closed, and a seal forming member on the valve seat, and the spherical body being seated on the valve seat through the seal forming member.

2. The ventilation apparatus according to claim 1 wherein at least one of the spherical bodies moves up and down by means of at least one of a gravity force, a force caused by a pressure difference, a pressure differential, between the inside and outside of the ventilating apparatus and a level change of a liquid that enters from the conduit.

3. The ventilation apparatus according to claim 2 wherein the conduit is a drain pipe, the liquid is waste water, and the gas is an ambient atmosphere, and the ventilation apparatus is a drain pipe ventilation apparatus.

4. The ventilation apparatus according to claim 3 wherein the spherical body is a ball of which water line when floating on water is below the center of the ball.

5. The ventilation apparatus according to claim 4 comprising a valve seat for the spherical body moving up at an upper end side of the first ventilation pipe, a stopper for the spherical body moving down at a lower end side of the first ventilation pipe, a valve seat for the spherical body moving down at a lower end side of the second ventilation pipe, and a stopper for the spherical body moving up at an upper end side of the second ventilation pipe, wherein when at least one spherical body is seated on the valve seat, the gas path is closed.

6. The ventilation apparatus according to claim 5 wherein a seal forming member is placed on the valve seat, and the spherical body is seated on the valve seat through the seal forming member.

7. The ventilation apparatus according to claim 6 comprising at least three elongated members as guide means to assist the spherical body in moving up and down wherein the guide means are connected to a ring member of which diameter is slightly larger than a diameter of the spherical body so as to form an inner sleeve, which is placed in each of the ventilation pipes.

8. The ventilation apparatus according to claim 3 comprising a valve seat for the spherical body moving up at an upper end side of the first ventilation pipe, a stopper for the spherical body moving down at a lower end side of the first ventilation pipe, a valve seat for the spherical body moving down at a lower end side of the second ventilation pipe, and a stopper for the spherical body moving up at an upper end side of the second ventilation pipe, wherein when at least one spherical body is seated on the valve seat, the gas path is closed.

9. The ventilation apparatus according to claim 8 wherein a seal forming member is placed on the valve seat, and the spherical body is seated on the valve seat through the seal forming member.

10. The ventilation apparatus according to claim 1 wherein the conduit is a drain pipe, the liquid is waste water, and the gas is an ambient atmosphere, and the ventilation apparatus is a drain pipe ventilation apparatus.

11. The ventilation apparatus according to claim 10 wherein the spherical body is a ball of which water line when floating on water is below the center of the ball.

12. The ventilation apparatus according to claim 11 comprising a valve seat for the spherical body moving up at an upper end side of the first ventilation pipe, a stopper for the spherical body moving down at a lower end side of the first ventilation pipe, a valve seat for the spherical body moving down at a lower end side of the second ventilation pipe, and a stopper for the spherical body moving up at an upper end side of the second ventilation pipe, wherein when at least one spherical body is seated on the valve seat, the gas path is closed.

13. The ventilation apparatus according to claim 12 comprising at least three elongated members as guide means to assist the spherical body in moving up and down wherein the guide means are connected to a ring member of which diameter is slightly larger than a diameter of the spherical body so as to form an inner sleeve, which is placed in each of the ventilation pipes.

14. The ventilation apparatus according to claim 10 comprising at least three elongated members as guide means to assist the spherical body in moving up and down wherein the guide means are connected to a ring member of which diameter is slightly larger than a diameter of the spherical body so as to form an inner sleeve, which is placed in each of the ventilation pipes.

15. The ventilation apparatus according to claim 1 wherein the spherical body is a ball of which water line when floating on water is below the center of the ball.

16. The ventilation apparatus according to claim 1 comprising at least three elongated members as guide means to assist the spherical body in moving up and down wherein the guide means are connected to a ring member of which diameter is slightly larger than a diameter of the spherical body so as to form an inner sleeve, which is placed in each of the ventilation pipes.

17. A ventilating apparatus to vent a drainage system including a drain pipe that drains liquid from a liquid container which apparatus comprises a first ventilation pipe and a second ventilation pipe each having a spherical body which freely moves up and down therein wherein the first ventilation pipe has an opening at a lower end thereof to connect to a gas phase of the liquid surface in the drain pipe, the second ventilation pipe has an opening at a lower end thereof to serve as an intake port for the gas to be supplied, an upper end of the first ventilation pipe and an upper end of the second ventilation pipe are communicated with each other so that a gas path is formed from the lower end of the second ventilation pipe to the lower end of the first ventilation pipe, the gas path being opened and closed by at least one of the spherical bodies moving up and down in the ventilation pipe in accordance to a force acting on the spherical body, a valve seat for the spherical body moving up at an upper end side of the first ventilation pipe, a stopper for the spherical body moving down at a lower end side of the first ventilation pipe, a valve seat for the spherical body moving down at a lower end side of the second ventilation pipe, and a stopper for the spherical body moving up at an upper end side of the second ventilation pipe, wherein when at least one spherical body is seated on the valve seat, the gas path is closed, and a seal forming member on the valve seat, and the spherical body being seated on the valve seat through the seal forming member.

18. The ventilating apparatus according to claim 17 wherein the liquid container is one of a tank, toilet bowl, wash basin or the like.

19. A ventilating apparatus to supply a gas to a conduit which apparatus comprises a first ventilation pipe and a second ventilation pipe each having a spherical body which freely moves up and down therein wherein the first ventilation pipe has an opening at a lower end thereof to connect to the conduit at a predetermined point, the second ventilation pipe has an opening at a lower end thereof to serve as an intake port for the gas to be supplied, an upper end of the first ventilation pipe and an upper end of the second ventilation pipe are communicated with each other so that a gas path is formed from the lower end of the second ventilation pipe to the lower end of the first ventilation pipe, the gas path is opened and closed by at least one of the spherical bodies moving up and down in the ventilation pipe in accordance to a force acting on the spherical body, and at least three elongated members as guide means to assist the spherical body in moving up and down wherein the guide means are connected to a ring member of which diameter is slightly larger than a diameter of the spherical body so as to form an inner sleeve, which is placed in each of the ventilation pipes.

20. The ventilation apparatus according to claim 19 wherein at least one of the spherical bodies moves up and down by means of at least one of a gravity force, a force caused by a pressure difference, a pressure differential, between the inside and outside of the ventilating apparatus and a level change of a liquid that enters from the conduit.

21. The ventilation apparatus according to claim 20 wherein the conduit is a drain pipe, the liquid is waste water, and the gas is an ambient atmosphere, and the ventilation apparatus is a drain pipe ventilation apparatus.

22. The ventilation apparatus according to claim 21 wherein the spherical body is a ball of which water line when floating on water is below the center of the ball.

23. The ventilation apparatus according to claim 22 comprising a valve seat for the spherical body moving up at an upper end side of the first ventilation pipe, a stopper for the spherical body moving down at a lower end side of the first ventilation pipe, a valve seat for the spherical body moving down at a lower end side of the second ventilation pipe, and a stopper for the spherical body moving up at an upper end side of the second ventilation pipe, wherein when at least one spherical body is seated on the valve seat, the gas path is closed.

24. The ventilation apparatus according to claim 23 wherein a seal forming member is placed on the valve seat, and the spherical body is seated on the valve seat through the seal forming member.

25. The ventilation apparatus according to claim 24 comprising at least three elongated members as guide means to assist the spherical body in moving up and down wherein the guide means are connected to a ring member of which diameter is slightly larger than a diameter of the spherical body so as to form an inner sleeve, which is placed in each of the ventilation pipes.

26. The ventilation apparatus according to claim 21 comprising a valve seat for the spherical body moving up at an upper end side of the first ventilation pipe, a stopper for the spherical body moving down at a lower end side of the first ventilation pipe, a valve seat for the spherical body moving down at a lower end side of the second ventilation pipe, and a stopper for the spherical body moving up at an upper end side of the second ventilation pipe, wherein when at least one spherical body is seated on the valve seat, the gas path is closed.

27. The ventilation apparatus according to claim 26 wherein a seal forming member is placed on the valve seat, and the spherical body is seated on the valve seat through the seal forming member.

28. The ventilation apparatus according to claim 19 wherein the conduit is a drain pipe, the liquid is waste water, and the gas is an ambient atmosphere, and the ventilation apparatus is a drain pipe ventilation apparatus.

29. The ventilation apparatus according to claim 28 wherein the spherical body is a ball of which water line when floating on water is below the center of the ball.

30. The ventilation apparatus according to claim 29 comprising a valve seat for the spherical body moving up at an upper end side of the first ventilation pipe, a stopper for the spherical body moving down at a lower end side of the first ventilation pipe, a valve seat for the spherical body moving down at a lower end side of the second ventilation pipe, and a stopper for the spherical body moving up at an upper end side of the second ventilation pipe, wherein when at least one spherical body is seated on the valve seat, the gas path is closed.

31. The ventilation apparatus according to claim 30 comprising at least three elongated members as guide means to assist the spherical body in moving up and down wherein the guide means are connected to a ring member of which diameter is slightly larger than a diameter of the spherical body so as to form an inner sleeve, which is placed in each of the ventilation pipes.

32. The ventilation apparatus according to claim 28 comprising at least three elongated members as guide means to assist the spherical body in moving up and down wherein the guide means are connected to a ring member of which diameter is slightly larger than a diameter of the spherical body so as to form an inner sleeve, which is placed in each of the ventilation pipes.

33. The ventilation apparatus according to claim 19 wherein the spherical body is a ball of which water line when floating on water is below the center of the ball.

34. A ventilating apparatus to supply a gas to a transportation pipe that carries a liquid which apparatus comprises a first ventilation pipe and a second ventilation pipe each having a spherical body which freely moves up and down therein wherein the first ventilation pipe has an opening at a lower end thereof to connect to a gas phase of the liquid surface in the transportation device, the second ventilation pipe has an opening at a lower end thereof to serve as an intake port for the gas to be supplied, an upper end of the first ventilation pipe and an upper end of the second ventilation pipe are communicated with each other so that a gas path is formed from the lower end of the second ventilation pipe to the lower end of the first ventilation pipe, the gas path being opened and closed by at least one of the spherical bodies moving up and down in the ventilation pipe in accordance to a force acting on the spherical body, and at least three elongated members as guide means to assist the spherical body in moving up and down wherein the guide means are connected to a ring member of which diameter is slightly larger than a diameter of the spherical body so as to form an inner sleeve, which is placed in each of the ventilation pipes.

35. The ventilating apparatus according to claim 34 wherein the transportation pipe is a drain pipe.

* * * * *